US009060587B2

(12) United States Patent
Pschirer et al.

(10) Patent No.: US 9,060,587 B2
(45) Date of Patent: Jun. 23, 2015

(54) PENCIL

(71) Applicant: Faber-Castell AG, Stein (DE)

(72) Inventors: Udo Pschirer, Selb (DE); Juergen Raps, Hof (DE)

(73) Assignee: Faber-Castell AG, Stein (DE)

( * ) Notice: Subject to any disclaimer, the term of this patent is extended or adjusted under 35 U.S.C. 154(b) by 0 days.

(21) Appl. No.: 14/159,667

(22) Filed: Jan. 21, 2014

(65) Prior Publication Data

US 2014/0205358 A1 Jul. 24, 2014

(30) Foreign Application Priority Data

Jan. 21, 2013 (EP) ..... 13152003

(51) Int. Cl.

| | |
|---|---|
| ***A46B 17/08*** | (2006.01) |
| ***A45D 40/26*** | (2006.01) |
| *A45D 34/04* | (2006.01) |

(52) U.S. Cl.

CPC ..... *A45D 40/26* (2013.01); *A45D 40/267* (2013.01); *A45D 34/045* (2013.01); *A45D 34/046* (2013.01); *A45D 34/043* (2013.01); *A45D 40/265* (2013.01); *A45D 40/264* (2013.01); *A45D 40/262* (2013.01)

(58) Field of Classification Search

USPC ..... 401/121, 122, 224, 225, 247–247

See application file for complete search history.

(56) References Cited

U.S. PATENT DOCUMENTS

| | | | | |
|---|---|---|---|---|
| 3,565,540 | A | 2/1971 | Andrews | |
| 4,759,651 | A * | 7/1988 | Manusch et al. | 401/194 |
| 4,917,522 | A * | 4/1990 | Kay et al. | 401/269 |
| 6,517,273 | B2 * | 2/2003 | Koyama et al. | 401/198 |
| 2008/0056807 | A1 | 3/2008 | Vintimiglia | |
| 2010/0040404 | A1 | 2/2010 | Zahn et al. | |

FOREIGN PATENT DOCUMENTS

| | | | |
|---|---|---|---|
| DE | 3538077 | C1 | 12/1986 |
| FR | 2905242 | A1 | 3/2008 |
| NL | 6913701 | A | 9/1970 |

* cited by examiner

*Primary Examiner* — David Walczak

(74) *Attorney, Agent, or Firm* — Laurence A. Greenberg; Werner H. Stemer; Ralph E. Locher

(57) ABSTRACT

A pencil has a shaft with a rear portion and a front portion which bears an application element on its front end. The pencil further has a cap which has on its rear end facing the shaft an opening, by way of which it is placed onto the front portion in the non-use state of the pencil. Inside the cap is a receiving sleeve, which receives the application element and has on its rear end facing the shaft an insertion opening for the application element. The receiving sleeve is guided so as to be axially movable between a first end position and a second end position. The receiving sleeve is arranged fully inside the cap in the first end position and its rear end projects out of the opening of the cap with a projection in the second end position.

13 Claims, 6 Drawing Sheets

E2

PENCIL

CROSS-REFERENCE TO RELATED APPLICATION

This application claims the priority, under 35 U.S.C. §119, of European application EP 13 152 003.3, filed Jan. 21, 2013; the prior application is herewith incorporated by reference in its entirety.

BACKGROUND OF THE INVENTION

Field of the Invention

The invention relates to a pencil with a shaft which includes a rear portion and a front portion, an application element being arranged on the front end of the front portion. In addition, the pencil includes a cap to be placed onto the front portion of the shaft. In the shaft there is a reservoir, which is fluidically connected to the application element, for an application medium, for example a cosmetic preparation which is applied to the skin or also to a different substrate by the application element. The application element, in this case, can be realized depending on the application, for example in the case of cosmetic pencils, as a small brush, small sponge or the like.

In the case of pencils of the aforementioned type, there is frequently a relatively large amount of application medium still present on the application elements after use. When placing the cap onto the front portion of the shaft once the pencil has been utilized or before use when removing the shaft out of the cap, the application element can easily come into contact with the cap such that in particular the rear region surrounding the opening of the cap and the front portion of the shaft onto which the contaminated cap is placed, are visibly contaminated.

SUMMARY OF THE INVENTION

It is the object of the invention to provide a pencil where contamination of the cap and the shaft is excluded or at least reduced.

The pencil includes a shaft having a rear portion and a front portion which bears an application element on its front end, and a cap which has on its rear end facing the shaft an opening, by way of which it is placed onto the front portion of the shaft in the non-use state of the pencil. Inside the cap a receiving sleeve, which receives the application element and has on its rear end facing the shaft an insertion opening for the application element, is guided so as to be axially movable between a first end position and a second end position. In this case, the receiving sleeve is arranged fully inside the cap in the first end position and its rear end projects out of the opening of the cap with a projection in the second end position.

The invention provides above all the advantage that the application element does not come into contact with the cap or with the rear end thereof facing the shaft, but simply with the receiving sleeve which is arranged inside the cap. As a result, contamination of the cap, in particular in the placing on region, is reliably prevented.

In order to move the receiving sleeve into its second end position, it is conceivable to provide inside the cap a spring mechanism which is actuatable by the user, which would, however, be linked to a high level of expenditure. In the case of a particularly preferred design variant, however, between the receiving sleeve and the shaft there is a movement coupling which is developed in such a manner that when the cap is removed from the shaft, the receiving sleeve, proceeding from its first end position, is moved quasi-automatically in the direction of extension into its second end position, that is without any measures necessary on the part of the user. The receiving sleeve is placed onto a longitudinal portion of the shaft for movement coupling, the reciprocal fixing in the axial direction being effected by a in each case detachable form-locking connection and/or a force-locking connection.

In the non-use position, the cap is placed onto the front portion of the shaft and the receiving sleeve is situated in the first end position and consequently is fully inside the cap. To utilize the pencil, the shaft is pulled out of the cap and the receiving sleeve is moved in the axial direction into the second end position on account of the said movement coupling such that the rear end projects out of the opening of the cap. In other words, the receiving sleeve performs an axial extension movement in the direction of extension. The direction of extension and in the direction of the rear portion of the shaft are used below in a synonymous manner. The shaft or the front portion thereof which supports the application element and which is arranged in the non-use state inside the receiving sleeve is moved further in the direction of extension and out of the receiving sleeve once the second end position has been reached. When the cap is placed onto the front portion of the shaft, in the reverse pull first of all at least the front end of the front portion, on which the application element is arranged, is inserted into the receiving sleeve, while the latter is situated in the second end position, and then the receiving sleeve is moved from the second end position back into the first end position. In other words, the receiving sleeve performs a retracting movement in the direction of retraction that is in the direction of the front portion of the shaft.

As is detailed further above, the receiving sleeve is placed onto a longitudinal portion of the front shaft portion. In the case of a preferred development, it does not abut, in this case however, extensively against the longitudinal portion, but against radially outwardly protruding, axially extending ribs. On the one hand, in this case, only the face regions of the ribs abutting against the inside of the receiving sleeve can be contaminated with application medium, not however the entire circumferential face of the longitudinal portion holding the receiving sleeve. From a production viewpoint, the advantage of the development is that the tolerances to be maintained with regard to a sufficient connecting strength between the receiving sleeve and the shaft are less critical than is the case in the case of the reciprocal extensive abutment of cylindrical faces. In the event of ribs which have different dimensions in the radial direction, the receiving sleeve is able to compensate for this by assuming, for example, an oval form.

The longitudinal portion, onto which the receiving sleeve is placed or can be placed, is defined at its rear end by a stop face which projects from the circumferential face thereof, extends over the entire circumference thereof in a radial plane, against which stop face the rear end face of the receiving sleeve abuts. In this case, the stop face serves not only as an end stop for the receiving sleeve, but seals off the interior of the receiving sleeve from the surrounding area. As a result, application medium is prevented from passing to the outside and for instance being able to contaminate the shaft. In addition, volatile constituents of the application medium contained in the reservoir are prevented from escaping into the atmosphere.

It is additionally advantageous when the receiving sleeve ends with an axial spacing in front of the opening of the cap in the first end position. In the non-use state, therefore, there is no receiving sleeve inside a longitudinal portion of the cap which faces the shaft and extends away from the opening of the cap such that the front portion of the shaft which is inserted into the cap is at least in part in contact with the inside face of the cap in the longitudinal portion. By use of fixing or clamping elements which are present on the front portion of the shaft and in the longitudinal portion of the cap, the shaft is thus able to be held securely in the cap in the non use state and secured against slipping out and an interior of the cap is able to be sealingly closed in relation to the surrounding area. The fixing or clamping, in this case, can be realized, for example, by projections which are present on the front portion and counter projections which are present on the inside face of the cap or however also by a thread.

In the case of a preferred development, at least one longitudinal portion of the rear end of the receiving sleeve which forms the projection is dimensioned in the radial direction such that it is movable axially in a contact-free manner in a longitudinal portion of the cap which extends away from the opening. In other words, a rear longitudinal portion of the cap has, for example, an inner cone, the inside width of which is greater than an outside width of a rear sleeve portion. As a result, both in the first and in the second end position, between at least the longitudinal portion of the receiving sleeve which forms the projection and the rear longitudinal portion of the cap there is an annular space which surrounds the receiving sleeve for example in a full manner. Application medium which is possibly removed when the application element is placed onto the receiving sleeve and which has not been used up during use, is able to "escape" into the annular space when the receiving sleeve retracts from the second into the first end position and the placing-on region of the cap remains clean.

In the first end position, the receiving sleeve is placed fully on the ribs in the axial direction, as a result of which a movement coupling in the form of a form-fitting connection and/or a force-fitting connection is produced between the receiving sleeve and the ribs. In other words, the receiving sleeve is clamped on the shaft. When the shaft is pulled out of the cap, that is, the extension movement the clamping effect initially remains such that the receiving sleeve is moved into the second end position. Once the second end position has been reached, the form-locking connection and/or the force-locking connection is released, that is the clamping effect is overcome, the receiving sleeve is able to slide down from the ribs and the front portion of the shaft is able to be removed completely out of the receiving sleeve and the cap. When the cap is placed in position that is during the retraction movement the application element is initially guided into the receiving sleeve, the latter is pushed at least over the conical part of the ribs and moved back in the retraction direction into the first end position. Once this has been achieved, the receiving sleeve is placed fully onto the ribs again and as a result is clamped on the ribs and consequently on the front portion of the shaft. The movement coupling between the receiving sleeve and the shaft is consequently produced again for the next use.

The receiving sleeve has an interior with a front interior region which receives the application element and a rear interior region. In the case of a preferred embodiment, between the front and the rear interior region there is a constriction, the inside width of which is smaller than an outside dimension of the application element in the radial direction. In the non-use state the constriction is situated in the extension direction behind the application element that is between the application element and the insertion opening of the receiving sleeve. The achievement of such a development is that the application element, which is developed for example as a small brush in the case of a cosmetic pencil, has to pass the constriction when being pulled out of the receiving sleeve and excessive application medium is removed from the application element. The excessive application medium consequently remains in the front interior region of the receiving sleeve and cannot result in any contamination in the placing on region.

In the case of an advantageous development, a stop, which protrudes radially outward from a circumferential face of the receiving sleeve, interacts with a counter stop of the cap in the second end position. For this purpose, for example, the front sleeve portion can have a greater outside dimension than an inside width of a longitudinal portion of the cap in the region of the constriction. The counter stop can also be formed, for example, by ribs which protrude radially out of the inside of the cap. The front sleeve portion is consequently held inside the cap in the second end position.

In the case of a preferred embodiment, in the second end position the receiving sleeve is also held in the cap by way of a clamping force which is greater than a force which is to be overcome when inserting the application element into the receiving sleeve. The force which is to be overcome refers, on the one hand, to the force necessary to pass the constriction, on the other hand, to the force necessary to produce the connection between the receiving sleeve and the shaft. Such a radially-effective clamping force can act, for example, between a rear sleeve portion, which surrounds the rear interior region of the receiving sleeve, and the cap and can be managed, for example, by a region of the rear sleeve portion which is widened radially toward the outside face or by projections which are provided on the outside face of the rear sleeve portion and which are clamped with the inside face of the cap. In the case of the retraction movement, the receiving sleeve is initially situated in the second end position and is initially held by the clamping force in the second end position such that the application element is inserted into the receiving sleeve. If the friction or the interaction between the application element and the constriction is great enough the clamping force is overcome. The receiving sleeve is consequently not moved at the start of the insertion operation such that the application element is initially inserted fully into the receiving sleeve and consequently no contamination of the cap is able to occur.

The rear interior region of the receiving sleeve is preferably widened in the direction of the insertion opening of the receiving sleeve. In other words, the rear interior region has the greatest inside width at the insertion opening and the smallest inside width at the constriction. As a result of such a conical narrowing of the receiving sleeve, the application element can be inserted easier in a targeted manner into the receiving sleeve and is, as it were, guided automatically in the rear sleeve portion without any strong interaction with the inside face of the receiving sleeve. As already described above, there is initially no movement of the receiving sleeve. Not until the application element passes the constriction of the receiving sleeve is the interaction with the receiving sleeve large enough, the clamping force is overcome, the receiving sleeve is moved into the first end position, pushed onto the ribs and pressed against the stop by way of its rear end face.

In the shaft of the pencil there is preferably a reservoir for an application medium which is in contact with the application element by a connecting channel which extends through the front portion. If the front portion is realized, for example, in a rod-shaped manner and the application element, for example the small brushes used to apply the application medium, is arranged on its front end, the connecting channel can be realized, for example, by an inner bore which extends from the reservoir as far as up to the application element.

In this case, it is advantageous when, in the region of the application element, that is, on the front end thereof, the front portion of the shaft has radial channels which lead to the outside thereof, are connected to the connecting channel and by means of which the application medium is able to be forwarded to the application element.

Other features which are considered as characteristic for the invention are set forth in the appended claims.

Although the invention is illustrated and described herein as embodied in a pencil, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
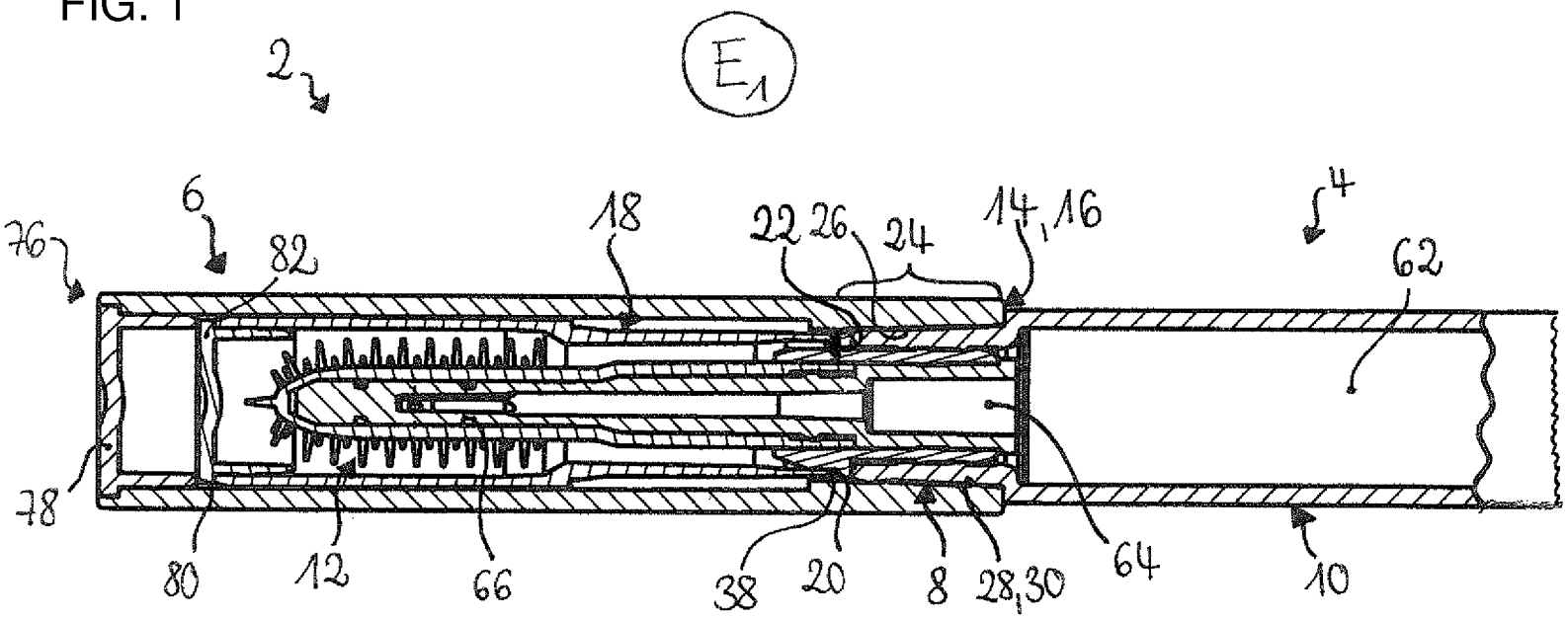
FIG. 1 is a diagrammatic, sectional view of a pencil in a non-use state with a shaft and with a cap which is placed onto a front portion of the shaft, according to the invention.

Referring now to the figures of the drawings in detail and first, particularly to FIG. 1 thereof, there is shown a pencil 2 with a shaft 4 and a cap 6. Such a shaft 4 has a front portion 8 and a rear portion 10. The shaft 4 supports an application element 12 on a front end of the front portion 8. The cap 6 has an opening 16 on its rear end 14 which faces the shaft 4. The pencil 2 shown in FIG. 1 is situated in the non-use state such that the cap 6 with the opening 16 is placed onto the front portion 8 of the shaft 4.

Figure 3:
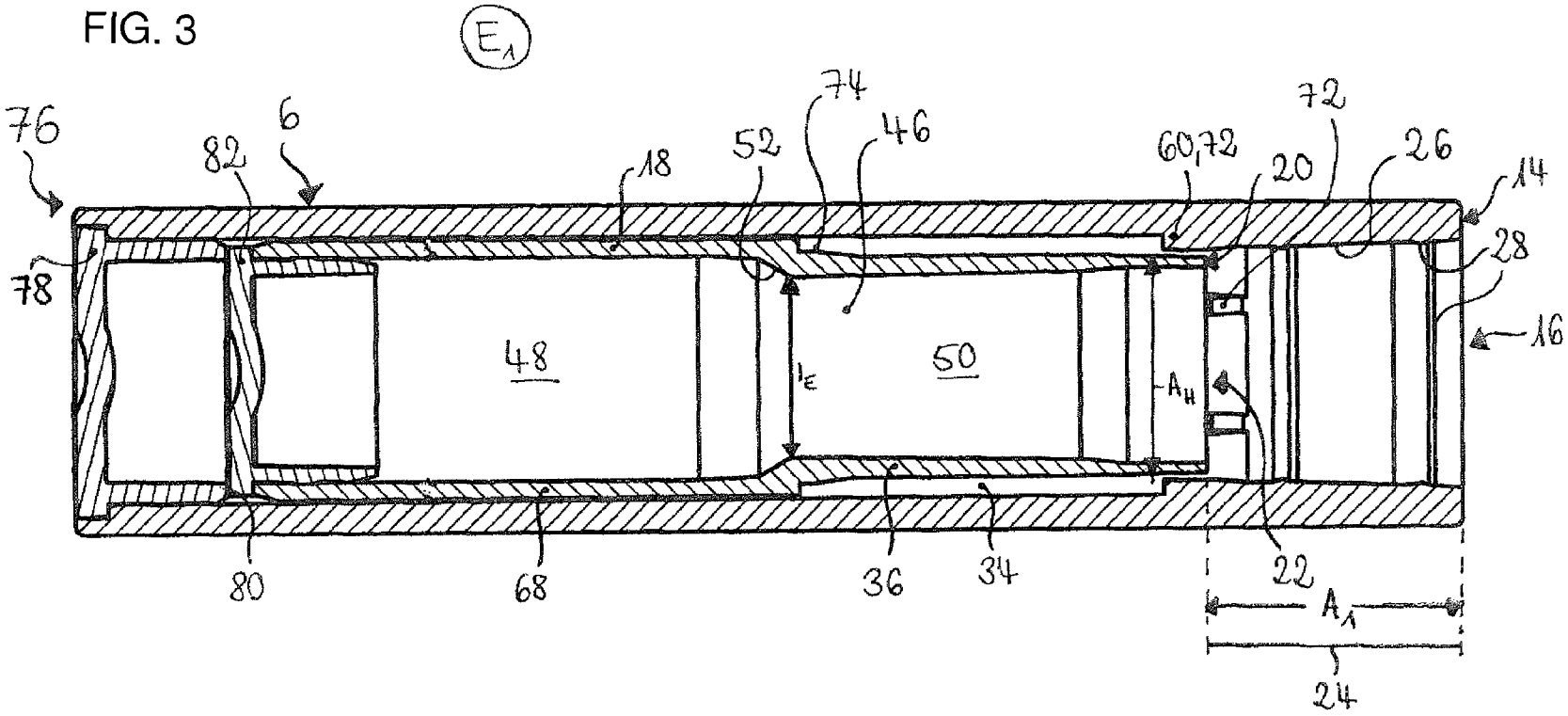
FIG. 3 is a sectional view of the cap with the receiving sleeve which is arranged inside the cap and is situated in a first end position.
Figure 4:
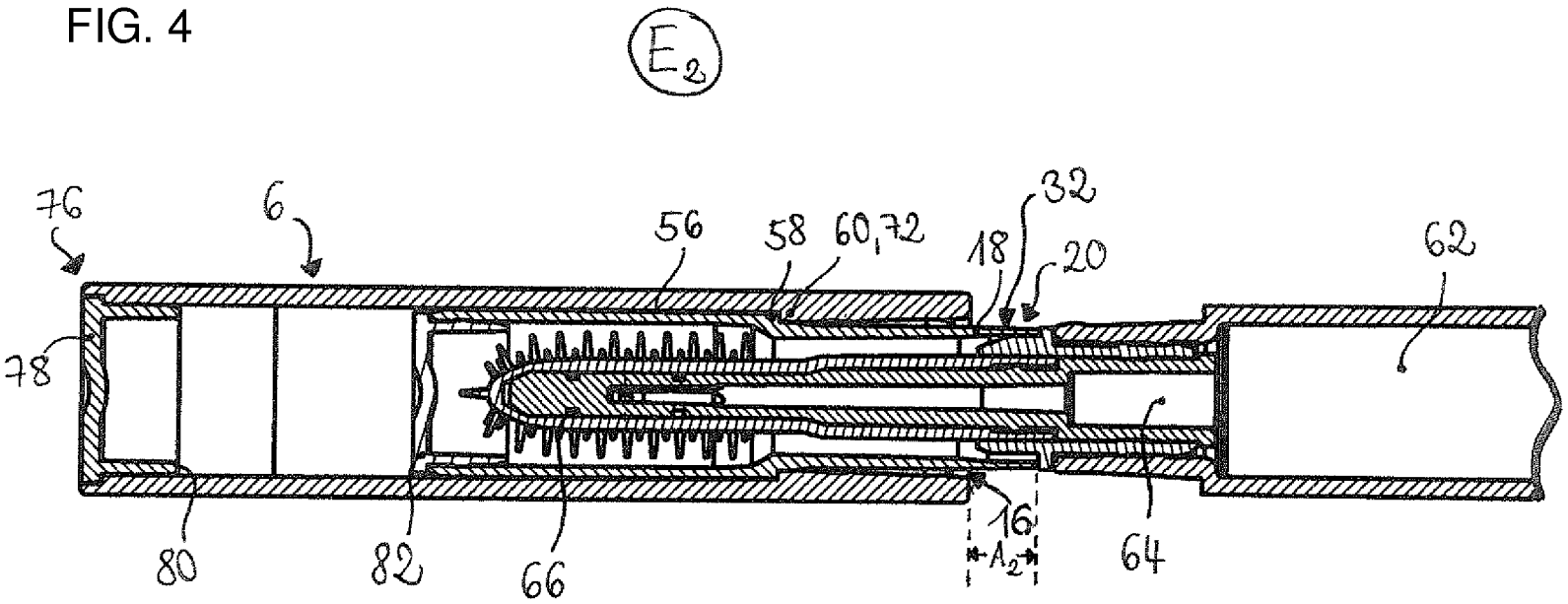
FIG. 4 is a sectional view of a part cutout of the pencil, wherein the front portion of the shaft protrudes in part out of the cap and the receiving sleeve is situated in a second end position.

There is a receiving sleeve 18 inside the cap 6 for receiving the application element 12. For this purpose, the receiving sleeve 18 includes an insertion opening 22 on its rear end 20 which faces the shaft 4. As claimed in the invention, the receiving sleeve 18 is guided in an axially movable manner between a first end position $E_1$ and a second end position $E_2$. In FIG. 1 (pencil with cap and shaft) and in FIG. 3 (pencil with cap and no shaft) the receiving sleeve 18 is situated in the first end position $E_1$ and is arranged fully inside the cap 6. In the second end position—as is shown in FIG. 4 (pencil with cap and shaft) and FIG. 5 (pencil with cap and no shaft)—the rear end 20 of the receiving sleeve 18 protrudes out of the opening 16 of the cap 6 with a projection $A_2$.

Figure 6:
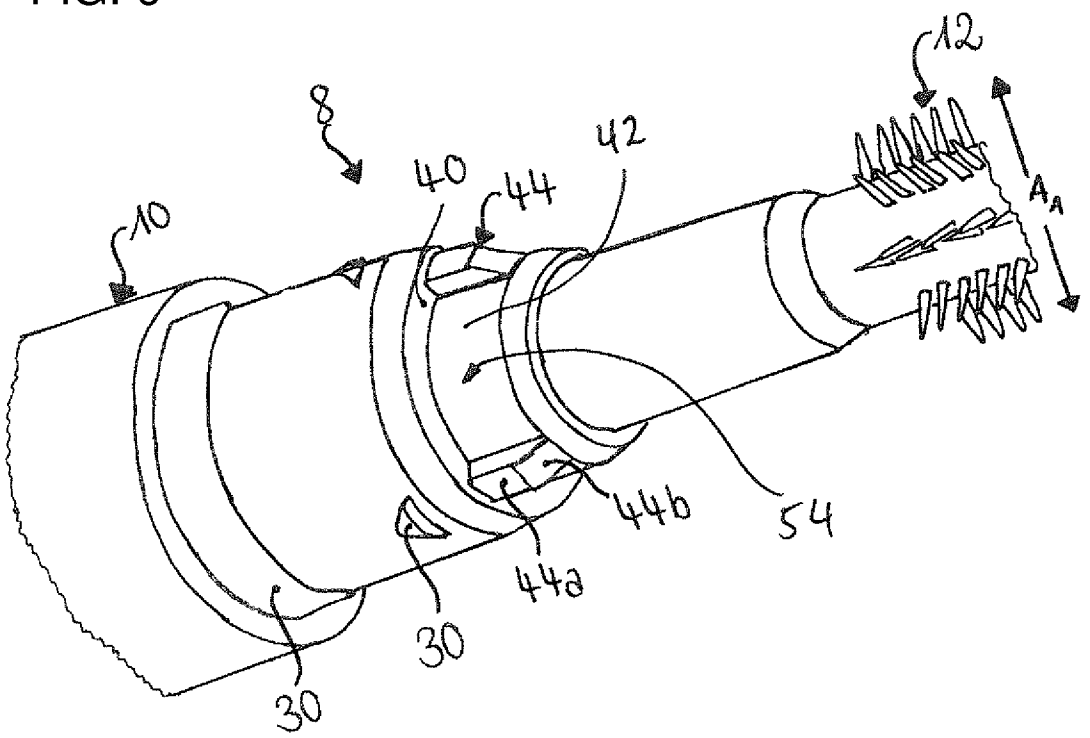
FIG. 6 is a perspective view of a part cutout of the front portion of the shaft.

The receiving sleeve 18 and the shaft 4 are coupled in such a manner that, when the cap 6 is removed from the shaft 4, the receiving sleeve 18 proceeding from the first end position $E_1$ is moved into the second end position $E_2$. This is managed as a result of a force-fitting connection between the receiving sleeve 18 and the shaft 4 by the receiving sleeve 18 being placed onto a longitudinal portion 54 of the front portion 8 (FIG. 6).

Figure 2:
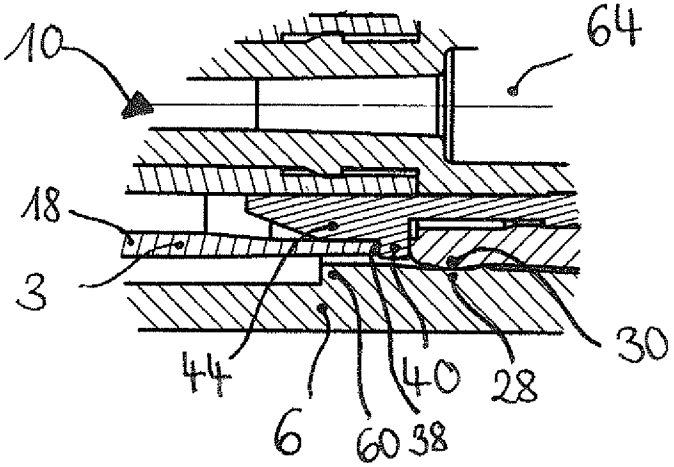
FIG. 2 is a partial, sectional view of a cutout of a detail of clamping between a receiving sleeve, which is arranged inside the cap, and the front portion of the shaft in the non-use state.

According to FIG. 2, a rear end face 38 of the receiving sleeve 18 abuts against a stop 40 which extends radially on the front portion 8 of the shaft 4 and surrounds the front portion 8 completely. In addition, the front portion 8 of the shaft 4 has axially extending ribs 44 which protrude radially out of an outside face 42 of the front portion 8. The ribs 44 are present in a region in front of the stop 40 and extend therefrom in the longitudinal direction in the direction of the front end of the front portion 8, that is, in the direction of the application element 12. The ribs 44, in this case, are arranged at least in part in the longitudinal portion 54. In addition, the ribs 44 protrude less far out of the outside face 42 of the front portion 8 than the stop 40. In a region 44*a* which faces the stop, the ribs 44 are realized initially at least approximately parallel to the outside face 42 of the shaft. A region 44*b* of the ribs 44, which extends away therefrom in the direction of the front end of the front portion 8, is realized as a run-up inclination which facilitates the placing-on of the receiving sleeve 18.

According to FIG. 1 and FIG. 2, the rear end face 38 of the receiving sleeve 18 abuts flatly against the stop 40 in the first end position $E_1$ and is placed fully onto the ribs 44 such that the force-locking connection between the receiving sleeve 18 and the shaft 4 is provided. The force-locking connection, for example a clamping action, remains until the receiving sleeve 18 is moved into the second end position $E_2$ (see FIG. 4).

In the first end position $E_1$ (FIG. 1 and FIG. 3) the receiving sleeve 18 ends with an axial distance $A_1$ in front of the opening 16 of the cap 6. As a result, there is no receiving sleeve 18 present in a longitudinal portion 24 of the cap 6 which extends away from the opening 16 of the cap 6 and the front portion 8 of the shaft 4 abuts in the rear longitudinal portion 24 at least in part directly against an inside face 26 of the cap 6. On the inside face 26 in the region of the longitudinal portion 24 there are fixing and/or clamping elements 28, for example grooves running around the inside face, and on the front portion 8 of the shaft 4 there are fixing and/or clamping elements 30, which, as shown in FIG. 6, are developed as an example as projections which project out of the circumferential face of the front portion 8. By means of the fixing and/or clamping elements 28, 30, the shaft 4 is held in the non-use state fixed in the cap 6 in a captive and releasable manner.

Figure 5:
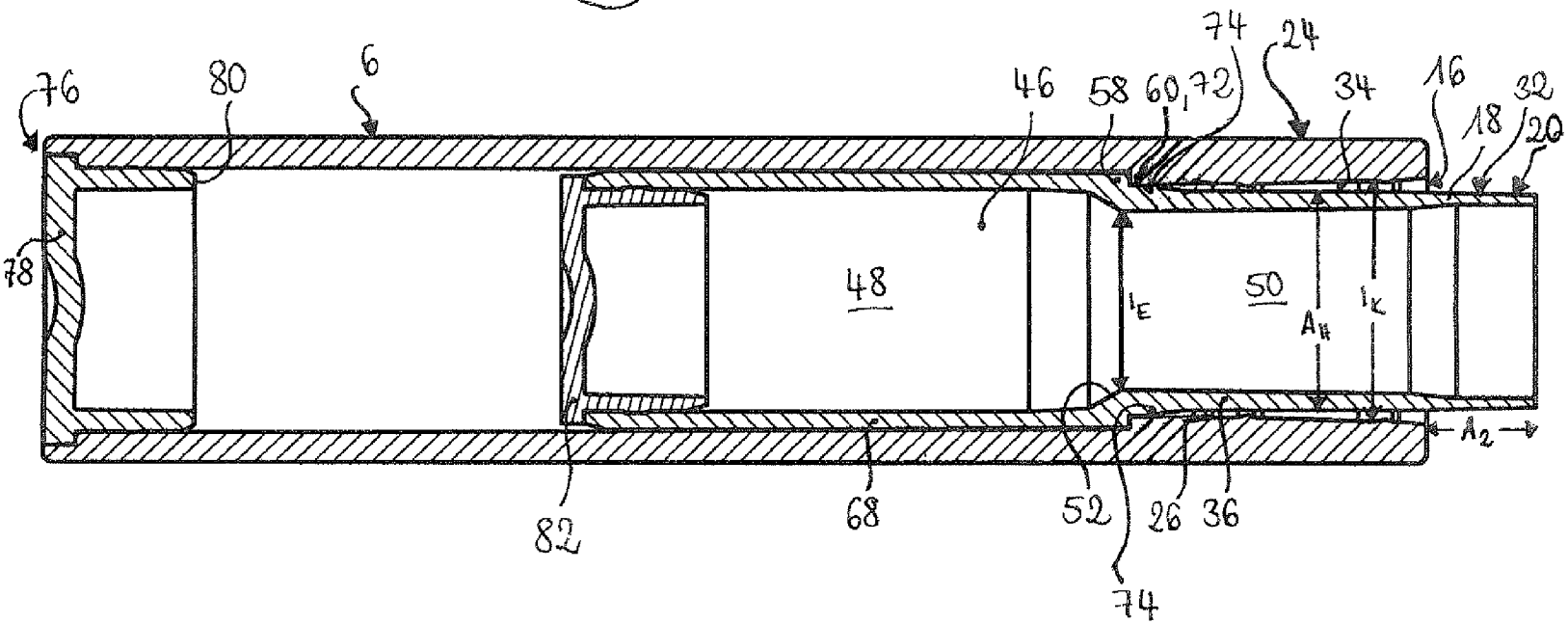
FIG. 5 is a sectional view of the cap with the receiving sleeve which is arranged inside the cap and is situated in a second end position.

According to FIG. 4 and FIG. 5 (at least) one longitudinal portion 32 of the rear end 20 of the receiving sleeve 18 which forms the projection $A_2$ is dimensioned in the radial direction such that the rear end 20 in a longitudinal portion 24 of the cap 6 which extends away from the opening 16 of the cap is axially movable in a non-contact manner in the cap. Both in the first end position $E_1$ (FIG. 3) and in the second end position $E_2$ (FIG. 5) an annular space 34 between the receiving sleeve 18 and the cap 6 is formed as a result of the development. For this purpose, the rear longitudinal portion 24, for example in the second end position $E_2$, has an inner cone, the inside width $I_K$ of which is greater than an outside dimension $A_H$ of a rear sleeve portion 36.

The receiving sleeve 18 defines an interior 46 with a front interior region 48 which receives the application element 12 and a rear interior region 50, the front interior region 48 being defined by the front sleeve portion 68 and the rear interior region 50 being defined by the rear sleeve portion 36. Between the front interior region 48 and the rear interior region 50 there is a constriction 52, the inside width $I_E$ of which is smaller than an outside dimension $A_A$ of the application element 12 in the radial direction. The constriction is formed by a transition from the front sleeve portion 68 to the rear sleeve portion 36. In the non-use state the application element 12 is arranged in the front interior region 48 according to FIG. 1 and the constriction 52 is situated between the application element 12 and the insertion opening 22. The application element 12, in this case, is arranged fully inside the front interior region 48. The rear interior region 50 is widened in the direction toward the insertion opening 22 in order to facilitate insertion of the application element 12 into the receiving sleeve 18 during the retraction movement. Both in the case of the extension movement and the retraction movement, the application element 12 has to pass the constriction 52 and excessive application medium is removed.

According to FIG. 4 and FIG. 5, in the second end position $E_2$ a stop 58, which protrudes radially outward from a circumferential face 56 of the receiving sleeve 18, interacts with a counter stop 60 on the inside face 26 of the cap 6. The stop 58 is formed by a radially widened front sleeve portion 68 and the counter stop 60 is formed by ribs 72 which are present on the inside face 26 of the cap 6.

In the second end position $E_2$ the receiving sleeve 18 is held against the cap 6 by way of a clamping force. There is therefore a radially-effective clamping force between the receiving sleeve 18 and the inside face 26 of the cap 6. For this reason, the rear sleeve portion 36 has, for example, a radially widened region 74 which is clamped with the inside face 26 and the receiving sleeve 18 is held initially in the second end position $E_2$ during the retraction movement.

The cap 6 is closed at the front end 76 thereof by a plug 78. The receiving sleeve 18 also has a plug 82 which closes the front side of the receiving sleeve 18. In the first end position $E_1$ the plug 82 abuts against an end face 80 of the plug 78. The plug 78 or the end face 80 thereof consequently forms a stop for the receiving sleeve 18 which establishes the first end position $E_1$.

In the shaft 4 there is a reservoir 62 for an application medium, for example ink or cosmetic liquid, which is in contact with the application element 12 by a connecting channel 64 which extends through the front portion 8. The connecting channel 64 is, for example, an inner bore which extends in the front portion 8 and connects the reservoir 62 to the application element 12. For this purpose, the front portion 8 has in the region of the application element 12 radial channels 66 which are connected to the connecting channel 64 in order to convey the application medium to the application element 12.

The invention claimed is:

1. A pencil, comprising:

a shaft having a rear portion and a front portion with a front end;

an application element disposed at said front end of said front portion;

a cap having a cap rear end facing said shaft and having an opening formed therein, by way of said opening said cap being placed onto said front portion in a non-use state of the pencil; and a receiving sleeve disposed inside said cap, said receiving sleeve receiving said application element and including a rear end facing said shaft and having an insertion opening formed therein for receiving said application element, said receiving sleeve being guided so as to be axially movable between a first end position and a second end position, said receiving sleeve disposed fully inside said cap in the first end position and said rear end of said receiving sleeve projecting out of said opening of said cap with a projection in the second end position, said receiving sleeve having an interior with a front interior region for receiving said application element and a rear interior region, between which there is a constriction, an inside width of said rear interior region being smaller than an outside dimension of said application element in a radial direction.

2. The pencil according to claim 1, wherein by a movement coupling between said receiving sleeve and said shaft in such a manner that when said cap is removed from said shaft, said receiving sleeve, proceeding from the first end position, is moved in a direction of extension into the second end position.

3. The pencil according to claim 2, wherein said shaft has a longitudinal portion and said receiving sleeve is placed in a force-locking and/or form-locking manner onto said longitudinal portion of said shaft for the movement coupling.

4. The pencil according to claim 3, wherein said longitudinal portion has radially outwardly protruding, axially extending ribs.

5. The pencil according to claim 3, wherein:

said receiving sleeve has a rear end face; and said longitudinal portion has a circumferential face and a rear end with a stop face projecting from said circumferential face and extending over an entire circumference in a radial plane, against said stop face, said rear end face of said receiving sleeve abuts.

6. The pencil according to claim 1, wherein said receiving sleeve ends with an axial spacing in front of said opening of said cap in the first end position.

7. The pencil according to claim 1, wherein said rear end of said receiving sleeve has at least one longitudinal portion which forms said projection in the second end position and is dimensioned in a radial direction such that said at least one longitudinal portion is movable axially in a contact-free manner in a longitudinal portion of said cap which extends away from said opening of said cap.

8. The pencil according to claim 1, wherein:

said cap has a counter stop; and said receiving sleeve has a circumferential face and a stop protruding radially outward from said circumferential face, said stop interacts with said counter stop of said cap in the second end position.

9. The pencil according to claim 1, wherein in the second end position said receiving sleeve is held in said cap by way of a clamping force which is greater than a force which is to be overcome when inserting said application element into said receiving sleeve.

10. The pencil according to claim 1, further comprising a connecting channel; and wherein said shaft has a reservoir for an application medium which is in contact with said application element by means of said connecting channel which extends through said front portion.

11. The pencil according to claim 10, wherein in a region of said application element, said front portion has radial channels connected to said connecting channel.

12. The pencil according to claim 1, wherein said constriction is positioned such that said application element passes said constriction during both an extension and a retraction movement of said sleeve for removing excessive application material.

13. The pencil according to claim 1, wherein said application element is a brush or sponge for applying application material.

* * * * *